US011421377B2

(12) United States Patent
Mao et al.

(10) Patent No.: US 11,421,377 B2
(45) Date of Patent: Aug. 23, 2022

(54) SUPER-HYDROPHOBIC FABRIC AND PREPARATION METHOD THEREOF

(71) Applicant: DONGHUA UNIVERSITY, Shanghai (CN)

(72) Inventors: Zhiping Mao, Shanghai (CN); Lingli Liu, Shanghai (CN); Ruyi Xie, Shanghai (CN); Xiaofeng Sui, Shanghai (CN); Hong Xu, Shanghai (CN); Linping Zhang, Shanghai (CN); Yi Zhong, Shanghai (CN)

(73) Assignee: DONGHUA UNIVERSITY, Shanghai (CN)

( * ) Notice: Subject to any disclaimer, the term of this patent is extended or adjusted under 35 U.S.C. 154(b) by 546 days.

(21) Appl. No.: 16/349,295

(22) PCT Filed: Aug. 16, 2017

(86) PCT No.: PCT/CN2017/097649
§ 371 (c)(1),
(2) Date: May 13, 2019

(87) PCT Pub. No.: WO2018/227751
PCT Pub. Date: Dec. 20, 2018

(65) Prior Publication Data

US 2020/0224361 A1 Jul. 16, 2020

(30) Foreign Application Priority Data

Jun. 15, 2017 (CN) ..... 201710454252.5

(51) Int. Cl.
*D06M 11/79* (2006.01)
*D06M 11/49* (2006.01)
(Continued)

(52) U.S. Cl.
CPC ..... *D06M 11/79* (2013.01); *D03D 15/217* (2021.01); *D03D 15/283* (2021.01); *D06M 11/49* (2013.01);
(Continued)

(58) Field of Classification Search
CPC ..... D06M 11/79; D06M 11/49; D06M 11/74; D06M 11/76; D06M 15/05; D06M 15/11; D03D 15/00
(Continued)

(56) References Cited

U.S. PATENT DOCUMENTS 2,750,305 A 6/1956 Gagarine et al.

FOREIGN PATENT DOCUMENTS

CN 101410439 4/2009
CN 101410439 A * 4/2009 ..... C09D 7/65
(Continued)

OTHER PUBLICATIONS

Machine translation of cn101410439 (Year: 2009).*
(Continued)

*Primary Examiner* — Vincent Tatesure
(74) *Attorney, Agent, or Firm* — JCIP Global Inc.

(57) ABSTRACT

The present invention provides super-hydrophobic fabrics and a preparation method thereof, and belong to the field of textiles. The super-hydrophobic fabrics are obtained by finishing Pickering emulsion formed by amphiphilic particles stabilizing low-surface-energy substances in water. Via a one-step finishing method using Pickering emulsion technology, facile preparation of durable super-hydrophobic fabrics is realized. The static contact angle between the finished fabric surfaces and water droplets is greater than 150 degrees, and the water droplets can roll off easily; and after being subjected to 30 times of standard washing tests, the finished fabrics still maintains excellent water repel-
(Continued)

lency. In addition, the Pickering emulsion preparation and finishing process of the present invention are environmentally friendly, pollution-free, facile to operate and widely applicable.

6 Claims, 1 Drawing Sheet

(51) Int. Cl.

| | |
|---|---|
| ***D06M 11/74*** | (2006.01) |
| ***D06M 11/76*** | (2006.01) |
| ***D06M 15/05*** | (2006.01) |
| ***D06M 15/11*** | (2006.01) |
| ***D03D 15/283*** | (2021.01) |
| ***D03D 15/217*** | (2021.01) |
| *D06M 101/06* | (2006.01) |
| *D06M 101/32* | (2006.01) |

(52) U.S. Cl.
CPC ..... *D06M 11/74* (2013.01); *D06M 11/76* (2013.01); *D06M 15/05* (2013.01); *D06M 15/11* (2013.01); *D06M 2101/06* (2013.01); *D06M 2101/32* (2013.01); *D06M 2200/12* (2013.01); *D10B 2201/02* (2013.01)

(58) Field of Classification Search
USPC ..... 428/221
See application file for complete search history.

(56) References Cited

FOREIGN PATENT DOCUMENTS

| | | | |
|---|---|---|---|
| CN | 101704529 B | * | 6/2011 |
| CN | 104131468 | | 11/2014 |
| CN | 105970610 | | 9/2016 |
| CN | 106567257 | | 4/2017 |

OTHER PUBLICATIONS

CN-101410439-A machine translation (Year: 2009).*
CN-101704529-B machine translation (Year: 2011).*
"International Search Report (Form PCT/ISA/210)", dated Mar. 15, 2018, with English translation thereof, pp. 1-4.

* cited by examiner

SUPER-HYDROPHOBIC FABRIC AND PREPARATION METHOD THEREOF

CROSS-REFERENCE TO RELATED APPLICATION

This application is a 371 application of International PCT application serial no. PCT/CN2017/097649, filed on Aug. 16, 2017, which claims the priority benefit of Chinese application no. 201710454252.5, filed on Jun. 15, 2017. The entirety of each of the above-mentioned patent applications is hereby incorporated by reference herein and made a part of this specification.

BACKGROUND

Technical Field

The present invention belongs to the field of functional textiles, and particularly relates to super-hydrophobic fabrics and a finishing method for preparing durable super-hydrophobic fabrics through a one-step method by using Pickering emulsion technology.

Description of Related Art

Surface wettability is one of the most common phenomena in nature and plays an important role in daily life and industrial and agricultural production. A bionic super-hydrophobic fabric is always highly appreciated by academia as well as industry and commerce because of its good self-cleaning, anti-fouling, water-repellent and anti-adhesion properties. Generally, fabrics with excellent super-hydrophobicity can be achieved by introducing low-surface-energy compounds such as long-chain alkane, organosilicon or organic fluorine via physical or chemical surface treatment methods, or first building a rough structure on the fabric surface and decorating with low-surface-energy compounds. While in practical applications, the main issue on a finished fabric is its poor washability and soaping resistance. Conventionally, the approaches to improve durability are involved with cross-linking agents, such as silane coupling agents, urea formaldehyde cross-linking agents and epoxy compound cross-linking agents in a system. The purpose is to cross-link the coating or introduce covalent bonds between the fabric and the coating.

In addition, concerning the industrial production, low-surface-energy substances are mostly directly used for finishing fabric surfaces. Though it endows the fabrics with an appropriate hydrophobicity (a contact angle is about 120 degrees) by the finishing, a rough structure is required to be introduced afterwards in order to exhibit super-hydrophobicity (a contact angle is larger than 150 degrees), and this may increase the complexity of the finishing process. What is worse, solvents that are harmful to human bodies and the environment or poisonous and harmful gas may be released during a super-hydrophobic finishing process. Therefore, it is especially important to develop a facile and environment-friendly finishing method for preparing durable super-hydrophobic fabrics.

Pickering emulsion technology is a new method to stabilize emulsions by solid particles instead of traditional surfactants. The interface stability of emulsions can be enhanced by those solid particles irreversibly adsorbing at the interface between two incompatible phases. Besides, most of the Pickering emulsions have the advantages of environmental protection, sustainability, low cost, facile operation and so on. Nowadays, Pickering emulsions are widely applied to the industries of food, cosmetics and pharmaceuticals, but limited to the textile applications.

SUMMARY

The present invention aims to provide super-hydrophobic fabrics and a preparation method thereof, through a facile finishing process. It provides fabrics with excellent super-hydrophobicity, solves the problem of poor durability and improves the additional value and practicality of fabrics. As well, the application area of super-hydrophobic fabrics is expanded.

In order to achieve the above objects, the present invention provides super-hydrophobic fabrics which are obtained through finishing by amphiphilic particles stabilizing low-surface-energy substances in water.

The present invention further provides a method for preparing durable super-hydrophobic fabrics through a one-step method by using Pickering emulsion technology, and the method includes: amphiphilic particles stabilizing low-surface-energy substances in water to form Pickering emulsion, finishing a textile through the one-step method by using the Pickering emulsion, and drying the textile to obtain a super-hydrophobic fabric.

Preferably, the Pickering emulsion is oil-in-water type emulsion.

Preferably, the amphiphilic particles are at least one of amphiphilic silicon dioxide, amphiphilic graphene oxide, amphiphilic graphene, amphiphilic carbon nanotubes, amphiphilic calcium carbonate, amphiphilic ferroferric oxide, microcrystalline celluloses, microcrystalline lignin and starch nanocrystals.

Preferably, the low-surface-energy substances are at least one of silicone oil, long-chain alkane compounds with carbon atom number $n \geq 16$ and perfluoroalkyl compounds with carbon atom number $n \leq 6$.

Preferably, the textile is cellulosic fiber fabrics, polyester fiber fabrics, nylon, acrylic fiber fabrics, acetate fiber fabrics, wool fiber fabrics or blended fabrics from at least two kinds of the above-mentioned fabrics.

Preferably, the finishing method is a padding method, a dipping method, a coating method or a spraying method.

Preferably, the total concentration of amphiphilic particles and low-surface-energy substances in Pickering emulsions is 0-300 mg/mL, and is not 0; more preferably, the total concentration is 80-120 mg/mL.

Preferably, the mass ratio of amphiphilic particles to low-surface-energy substances in Pickering emulsions is 1:(0-30), and is not 0; more preferably, the mass ratio is 1:(1-10).

Preferably, the emulsifying method includes homogenizing dispersion, cell smashing or ultrasonic dispersion.

Preferably, the drying method includes pre-curing for 1-3 min at the temperature of 60-80° C. and further curing for 1-3 min at the temperature of 120-160° C., or drying for 30-60 min at the temperature of 120-150° C.

Stable oil-in-water type Pickering emulsion is formed by encapsulating low-surface-energy substances in water with amphiphilic particles at first, then a fabric is subjected to padding, dipping, coating or spraying application with the formed oil-in-water type Pickering emulsion, followed by drying and curing treatments, after which the particles stabilizing the emulsion can construct a rough structure on the fabric surface, and the hydrophobic silicone oil, long-chain alkane compounds or short-chain fluorohydrocarbon compounds contribute to the hydrophobicity for the rough fabric surface, and therefore, a durable super-hydrophobic fabric can be obtained immediately.

The fabric is finished by Pickering emulsion technology in the present invention, the super-hydrophobicity is achieved by using low-surface-energy substances and solid particles building rough structure together; and moreover, some of amphiphilic solid particles contain active functional groups which can be chemically bonded with fabric matrixes or low-surface-energy compounds, to improve the durability of super-hydrophobic fabrics.

The preparation method in the present invention is facile and widely applicable. Through a one-step method, low-surface-energy substances and rough structures are introduced simultaneously, and the super-hydrophobicity of fabrics is acquired immediately. After being subjected to several standard washing cycles, the fabric still maintains excellent water repellency. Besides, no toxic, harmful reagents or gases are involved during the preparation process which is environmentally friendly, and the final products exhibit good homogeneity and reproducibility, being beneficial for popularization and utilization.

The static contact angle between durable super-hydrophobic cotton fabrics prepared by the method in the present invention and water droplets of 5 μL reaches up to 156 degrees; The static contact angle between durable super-hydrophobic polyester fabrics prepared by the method in the present invention and water droplets of 5 μL reaches up to 154 degrees; and liquid droplets can roll off easily. Moreover, the finished fabrics can withstand at least 30 times of standard washing cycles.

Compared with existing technologies, the present invention has beneficial advantages as follows:

1, the preparation method of the present invention is simple and feasible, and is widely applicable;

2, the low-surface-energy substances and rough structures are introduced simultaneously through a one-step method, and the fabric super-hydrophobicity is realized immediately;

3, according to the ISO 105-C10: 2007 testing method, the finished fabrics in the present invention still maintain excellent water repellency after 30 times standard washing cycles;

4, no toxic, harmful reagents or gases are involved during the preparation process which is environmentally friendly, and the final products exhibit good homogeneity and reproducibility, being beneficial for popularization and utilization.

DESCRIPTION OF THE EMBODIMENTS

The present invention is further described below with reference to specific embodiments. It should be understood that these embodiments are used for construing the present invention only, but not limiting its scope. In addition, it should be understood that after reading contents described in the present invention, those skilled in the art can make various modifications or variations based on the present invention, and these equivalents are also within the scope defined by the appended claims of the present application.

In the present invention, the static contact angle testing is carried out by a pendant-drop method with a KRUSS GmbH DSA30 drop shape analyzer (German). The volume of water droplets is 5 μL.

Embodiment 1

Figure 1:
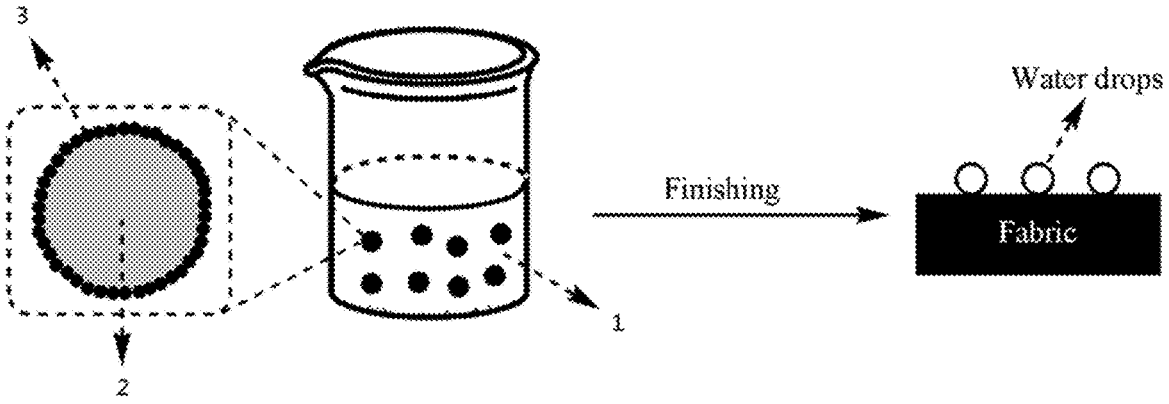
FIG. 1 is a schematic diagram of preparing a durable super-hydrophobic fabric through a one-step method utilizing Pickering emulsion technology.

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through homogenizing dispersion. The total concentration of amphiphilic particles and low-surface-energy substance in the prepared Pickering emulsion is 80 mg/mL, the mass ratio of amphiphilic particles to low-surface-energy substance is 1:1, the rotating speed of the homogenizer is 15,000 rpm, and the emulsifying time is 5 min.

A textile is finished by the Pickering emulsion through the one-step method: a bleached cotton woven fabric is subjected to conventional two-dipping and two-rolling finishing by using the stable oil-in-water type Pickering emulsion, and the pick-up ratio is 70%; and curing: the above finished bleached cotton woven fabric is pre-cured for 3 min at the temperature of 80° C., and is cured for 3 min at the temperature of 160° C. to obtain a durable super-hydrophobic bleached cotton woven fabric.

A static contact angle between the durable super-hydrophobic bleached cotton woven fabric and water droplets is 155 degrees, and after the durable super-hydrophobic bleached cotton woven fabric is washed for 30 times according to the ISO 105-C10: 2007 testing method, the static contact angle still reaches up to 153 degrees.

Figure 2A:
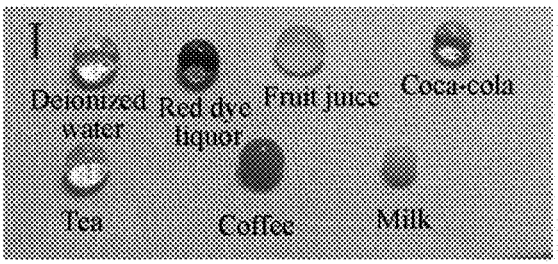
FIGS. 2A and 2B are respectively a diagram of hydrophobicity of a finished fabric in an embodiment 1 and an embodiment 2 of the present invention exposed to different liquids before standard washing.

In the embodiment, the lyophobic effect of the cotton fabric subjected to conventional padding finishing is as shown in FIG. 2A, the finished cotton fabric exhibits excellent hydrophobicity towards deionized water, red dye liquor, fruit juice, coca-cola, tea, coffee and milk liquid droplets, and the liquid droplets sit spherically on the finished fabric, and can roll off easily.

Figure 3A:
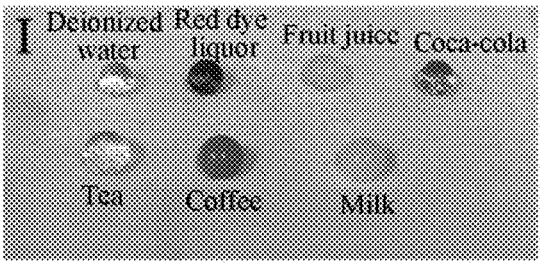
FIGS. 3A and 3B are respectively a diagram of hydrophobicity of the finished fabric in the embodiment 1 and the embodiment 2 of the present invention exposed to different liquids after 30 times standard washing cycles.

The durable and lyophobic effect of the cotton fabric subjected to conventional padding finishing in the embodiment is as shown in FIG. 3A, after being washed for 30 times according to the ISO 105-C10: 2007 testing method, the finished cotton fabric still exhibits excellent hydrophobicity on deionized water, red dye liquor, fruit juice, coca-cola, tea, coffee and milk liquid droplets, and the liquid droplets sit spherically on the finished fabric, and can roll off easily.

Embodiment 2

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through homogenizing dispersion. The total concentration of amphiphilic particles and low-surface-energy substance in the prepared Pickering emulsion is 120 mg/mL, the mass ratio of amphiphilic particles to low-surface-energy substance is 1:1, the rotating speed of the homogenizer is 15,000 rpm, and the emulsifying time is 5 min.

A textile is finished by the Pickering emulsion through the one-step method: a polyester fiber woven fabric is subjected to conventional two-dipping and two-rolling finishing by using the stable oil-in-water type Pickering emulsion, and the pick-up ratio is 70%; and curing: the above polyester fiber woven fabric is pre-cured for 3 min at the temperature of 80° C., and is cured for 3 min at the temperature of 160° C. to obtain a durable super-hydrophobic polyester fiber woven fabric.

A static contact angle between the durable super-hydrophobic polyester fiber woven fabric and water droplets is 152 degrees, and after the durable super-hydrophobic polyester fiber woven fabric is washed for 30 times according to the ISO 105-C10: 2007 testing method, the static contact angle is 150 degrees.

Figure 2B:
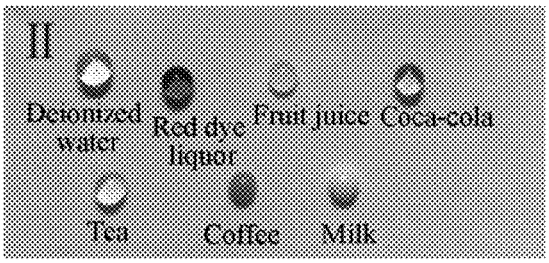

In the embodiment, the lyophobic effect of the polyester fiber woven fabric subjected to conventional padding finishing is as shown in FIG. 2B, the finished polyester fiber woven fabric exhibits excellent hydrophobicity towards deionized water, red dye liquor, fruit juice, coca-cola, tea, coffee and milk liquid droplets, and the liquid droplets sit spherically on the finished fabric, and can roll off easily.

Figure 3B:
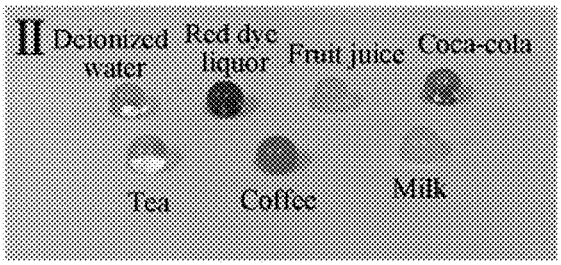

The durable and lyophobic properties of the polyester fiber woven fabric subjected to conventional padding finishing in the embodiment is as shown in FIG. 3B, after being washed for 30 times according to the ISO 105-C10: 2007 testing method, the finished polyester fiber woven fabric still exhibits excellent hydrophobicity on deionized water, red dye liquor, fruit juice, coca-cola, tea, coffee and milk liquid drops, and the liquid droplets sit spherically on the finished fabric, and can roll off easily.

Embodiment 3

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through a ultrasonic homogenizer. The total concentration of amphiphilic nanoparticles and low-surface-energy substance in the prepared Pickering emulsion is 120 mg/mL, the mass ratio of amphiphilic particles to low-surface-energy substance is 1:2, the ultrasonication power is 540 W, and the emulsifying time is 3 min.

A textile is finished by the Pickering emulsion through the one-step method: a bleached cotton woven fabric is subjected to conventional two-dipping and two-rolling finishing by using the stable oil-in-water type Pickering emulsion, and the pick-up ratio is 70%; and curing: the bleached cotton woven fabric is pre-cured for 3 min at the temperature of 80° C., and is cured for 3 min at the temperature of 160° C. to obtain a durable super-hydrophobic bleached cotton woven fabric.

A static contact angle between the durable super-hydrophobic bleached cotton woven fabric and water droplets is 155 degrees, and after the durable super-hydrophobic bleached cotton woven fabric is washed for 30 times according to the ISO 105-C10: 2007 testing method, the static contact angle still reaches up to 154 degrees.

Embodiment 4

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through a ultrasonic homogenizer. The total concentration of amphiphilic particles and low-surface-energy substance in the prepared Pickering emulsion is 120 mg/mL, the mass ratio of amphiphilic particles to low-surface-energy substance is 1:2, the ultrasonication power is 540 W, and the emulsifying time is 3 min.

A textile is finished by the Pickering emulsion through the one-step method: a polyester fiber woven fabric is subjected to conventional two-dipping and two-rolling finishing by the stable oil-in-water type Pickering emulsion, and the pick-up ratio is 70%; and curing: the above polyester fiber woven fabric is pre-cured for 3 min at the temperature of 80° C., and is cured for 3 min at the temperature of 160° C. to obtain a durable super-hydrophobic polyester fiber woven fabric.

A static contact angle between the durable super-hydrophobic polyester fiber woven fabric and water droplets is 150 degrees, and after the durable super-hydrophobic polyester fiber woven fabric is washed for 30 times according to the ISO 105-C10: 2007 testing method, the static contact angle still reaches up to 148 degrees.

Embodiment 5

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through homogenizing dispersion. The total concentration of amphiphilic particles and low-surface-energy substance in the prepared Pickering emulsion is 80 mg/mL, the mass ratio of amphiphilic particles to low-surface-energy substance is 1:2, the rotating speed of the homogenizer is 15,000 rpm, and the emulsifying time is 5 min.

A textile is finished by the Pickering emulsion through the one-step method: a bleached cotton woven fabric is dipped in the stable oil-in-water type Pickering emulsion for 10 min at room temperature, and then is taken out; and drying: the bleached cotton woven fabric is dried for 30 min at the temperature of 135° C. to obtain a durable super-hydrophobic bleached cotton woven fabric.

A static contact angle between the durable super-hydrophobic bleached cotton woven fabric and water droplets is 156 degrees, and after the durable super-hydrophobic bleached cotton woven fabric is washed for 30 times according to the ISO 105-C10: 2007 testing method, the static contact angle still reaches up to 153 degrees.

Embodiment 6

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through homogenizing dispersion. The total concentration of amphiphilic particles and low-surface-energy substance in the emulsion is 120 mg/mL, the mass ratio of amphiphilic particles to low-surface-energy substance is 1:2, the rotating speed of the homogenizer is 15,000 rpm, and the emulsifying time is 5 min.

A textile is finished by the Pickering emulsion through the one-step method: a polyester fiber woven fabric is dipped in the stable oil-in-water type Pickering emulsion for 10 min at room temperature, and then is taken out; and drying: the polyester fiber woven fabric is dried for 30 min at the temperature of 135° C. to obtain a durable super-hydrophobic polyester fiber woven fabric.

A static contact angle between the durable super-hydrophobic polyester fiber woven fabric and water droplets is 154 degrees, and after the durable super-hydrophobic polyester fiber woven fabric is washed for 30 times according to the ISO 105-C10: 2007 testing method, the static contact angle still reaches up to 150 degrees.

Embodiment 7

A super-hydrophobic fabric is obtained by finishing through Pickering emulsion formed by amphiphilic particles stabilizing low-surface-energy substances and water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through a ultrasonic homogenizer. The total concentration of amphiphilic particles and low-surface-energy substance in the prepared Pickering emulsion is 80 mg/mL, the mass ratio of amphiphilic particles to low-surface-energy substance is 1:2, the ultrasonication power is 540 W, and the emulsifying time is 3 min.

A textile is finished by the Pickering emulsion through the one-step method: a bleached cotton woven fabric is dipped in the stable oil-in-water type Pickering emulsion for 10 min at room temperature, and then is taken out; and drying: the bleached cotton woven fabric is dried for 30 min at the temperature of 135° C. to obtain a durable super-hydrophobic bleached cotton woven fabric.

A static contact angle between the durable super-hydrophobic bleached cotton woven fabric and water droplets is 154 degrees, and after the durable super-hydrophobic bleached cotton woven fabric is washed for 30 times according to the ISO 105-C10: 2007 testing method, the static contact angle still reaches up to 151 degrees.

Embodiment 8

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), low-surface-energy substance silicone oil (PDMS 4000, China Shanghai Momentive Organosilicon Material Co., Ltd.) and water are mixed, and are emulsified to form oil-in-water type Pickering emulsion through a ultrasonic homogenizer. The total concentration of amphiphilic particles and low-surface-energy substance in the prepared Pickering emulsion is 120 mg/mL, the mass ratio of amphiphilic particles to low-surface-energy substance is 1:5, the ultrasonication power is 540 W, and the emulsifying time is 3 min.

A textile is finished by the Pickering emulsion through the one-step method: a polyester fiber woven fabric is dipped in the stable oil-in-water type Pickering emulsion for 10 min at room temperature, and then is taken out; and drying: the polyester fiber woven fabric is dried for 30 min at the temperature of 135° C. to obtain a durable super-hydrophobic polyester fiber woven fabric.

A static contact angle between the durable super-hydrophobic polyester fiber woven fabric and water droplets is 154 degrees, and after the durable super-hydrophobic polyester fiber woven fabric is washed for 30 times according to the ISO 105-C10: 2007 testing method, the static contact angle still reaches up to 150 degrees.

Embodiment 9

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), a low-surface-energy substance perfluoroalkyl compound (1H, 1H, 2H, 2H-perfluorooctyl trimethoxysilane, China Hangzhou Hete Chemical Technology Co., Ltd.) and water are mixed, and are emulsified to form oil-in-water type Pickering emulsion through homogenizing dispersion. The total concentration of amphiphilic particles and low-surface-energy substance in the prepared Pickering emulsion is 80 mg/mL, the mass ratio of amphiphilic particles to low-surface-energy substance is 1:30, the rotating speed of a homogenizer is 15,000 rpm, and the emulsifying time is 5 min.

A textile is finished by the Pickering emulsion through the one-step method: a bleached cotton woven fabric is subjected to conventional two-dipping and two-rolling finishing by using the stable oil-in-water type Pickering emulsion, and the pick-up ratio is 70%; and curing: the bleached cotton woven fabric is pre-cured for 3 min at the temperature of 80° C., and is cured for 3 min at the temperature of 160° C. to obtain a durable super-hydrophobic bleached cotton woven fabric.

A static contact angle between the durable super-hydrophobic bleached cotton woven fabric and water droplets is 160 degrees, and after the durable super-hydrophobic bleached cotton woven fabric is washed for 30 times according to the ISO 105-C10: 2007 testing method, the static contact angle still reaches up to 158 degrees.

Embodiment 10

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic silicon dioxide particles (Bindzil CC40, Sweden Eka chemicals company), a low-surface-energy substance long-chain alkane compound (n-hexadecane, China Shanghai Sinopharm Chemical Reagent Co., Ltd.) and water are mixed, and are emulsified to form oil-in-water type Pickering emulsion through homogenizing dispersion. The total concentration of amphiphilic particles and low-surface-energy substance in the prepared Pickering emulsion is 300 mg/mL, the mass ratio of amphiphilic particles to low-surface-energy substance is 1:10, the rotating speed of the homogenizer is 15,000 rpm, and the emulsifying time is 5 min.

A textile is finished by the Pickering emulsion through the one-step method: a polyester fiber woven fabric is subjected to conventional two-dipping and two-rolling finishing by using the stable oil-in-water type Pickering emulsion, and the pick-up ratio is 70%; and curing: the polyester fiber woven fabric is pre-cured for 3 min at the temperature of 80° C., and is cured for 3 min at the temperature of 120° C. to obtain a durable super-hydrophobic polyester fiber woven fabric.

A static contact angle between the durable super-hydrophobic polyester fiber woven fabric and water droplets is 150 degrees, and after the durable super-hydrophobic polyester fiber woven fabric is washed for 30 times according to the ISO 105-C10: 2007 testing method, the static contact angle still reaches up to 148 degrees.

Embodiment 11

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substance are emulsified in water by amphiphilic particles to form stable oil-in-water type Pickering emulsions: amphiphilic ferroferric oxide particles (PuriMag200 Si-Epoxy, China Xiamen PuriMag Bead Biotechnology Co., Ltd.), low-surface-energy substance silicone oil (PDMS 4000, China Shanghai Momentive Organosilicon Material Co., Ltd.) and water are mixed, and are emulsified to form oil-in-water type Pickering emulsion through homogenizing dispersion. The total concentration of amphiphilic particles and low-surface-energy substance in the prepared Pickering emulsion is 80 mg/mL, the mass ratio of amphiphilic particles to low-surface-energy substance is 1:1, the rotating speed of the homogenizer is 15,000 rpm, and the emulsifying time is 5 min.

A textile is finished by the Pickering emulsion through the one-step method: a bleached cotton woven fabric is subjected to conventional two-dipping and two-rolling finishing by using the stable oil-in-water type Pickering emulsion, and the pick-up ratio is 70%; and curing: the bleached cotton woven fabric is pre-cured for 3 min at the temperature of 80° C., and is cured for 3 min at the temperature of 160° C. to obtain a durable super-hydrophobic bleached cotton woven fabric.

A static contact angle between the durable super-hydrophobic bleached cotton woven fabric and water droplets is 153 degrees, and after the durable super-hydrophobic bleached cotton woven fabric is washed for 30 times according to the ISO 105-C10: 2007 testing method, the static contact angle still reaches up to 150 degrees.

Embodiment 12

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by a Pickering emulsion technology includes:

the low-surface-energy substances are emulsified in water by amphiphilic particles to form stable oil-in-water type Pickering emulsions: amphiphilic microcrystalline celluloses (CNC-C, China Guangxi Guilin Qihong Keji Co., Ltd.), a low-surface-energy substance perfluoroalkyl compound (1H, 1H, 2H, 2H-perfluorooctyl trimethoxysilane, China Hangzhou Hete Chemical Technology Co., Ltd.) and water are mixed, and are emulsified to form oil-in-water type Pickering emulsion through homogenizing dispersion. The total concentration of amphiphilic particles and low-surface-energy substance in the prepared Pickering emulsion is 300 mg/mL, the mass ratio of amphiphilic particles to low-surface-energy substance is 1:0.5, the rotating speed of the homogenizer is 15,000 rpm, and the emulsifying time is 5 min.

A textile is finished by the Pickering emulsion through the one-step method: a bleached cotton woven fabric is subjected to conventional two-dipping and two-rolling finishing by using the stable oil-in-water type Pickering emulsion, and the pick-up ratio is 70%; and curing: the bleached cotton woven fabric is pre-cured for 3 min at the temperature of 80° C., and is cured for 3 min at the temperature of 160° C. to obtain a durable super-hydrophobic bleached cotton woven fabric.

A static contact angle between the durable super-hydrophobic bleached cotton woven fabric and water droplets is 152 degrees, and after the durable super-hydrophobic bleached cotton woven fabric is washed for 30 times according to the ISO 105-C10: 2007 testing method, the static contact angle still reaches up to 149 degrees.

Embodiment 13

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substance are emulsified in water by amphiphilic particles to form stable oil-in-water type Pickering emulsions: amphiphilic graphene oxide water-based dispersion liquid (XF020, China Nanjing Xianfeng Nano-Material Technology Co., Ltd.), low-surface-energy substance silicone oil (PDMS 4000, China Shanghai Momentive Organosilicon Material Co., Ltd.) and water are mixed, and are emulsified to form oil-in-water type Pickering emulsion through homogenizing dispersion. The total concentration of amphiphilic particles and low-surface-energy substance in the prepared Pickering emulsion is 80 mg/mL, the mass ratio of amphiphilic particles to low-surface-energy substance is 1:0.5, the rotating speed of the homogenizer is 15,000 rpm, and the emulsifying time is 5 min.

A textile is finished by the Pickering emulsion through the one-step method: a polyester fiber woven fabric is dipped in the stable oil-in-water type Pickering emulsion for 10 min at room temperature, and then is taken out; and drying: the polyester fiber woven fabric is dried for 30 min at the temperature of 135° C. to obtain a durable super-hydrophobic polyester fiber woven fabric.

A static contact angle between the durable super-hydrophobic polyester fiber woven fabric and water droplets is 150 degrees, and after the durable super-hydrophobic polyester fiber woven fabric is washed for 30 times according to the ISO 105-C10: 2007 testing method, the static contact angle still reaches up to 144 degrees.

Embodiment 14

A super-hydrophobic fabric is obtained by finishing through Pickering emulsion formed by amphiphilic particles stabilizing low-surface-energy substances in water. As shown in FIG. 1, the Pickering emulsion includes a water phase 1 and an oil phase, the oil phase is a low-surface-energy substance 2, and the amphiphilic particles 3 encapsulate the low-surface-energy substance 2.

A method for preparing the durable super-hydrophobic fabric through a one-step method by Pickering emulsion technology includes:

the low-surface-energy substances are emulsified in water by amphiphilic particles to form stable oil-in-water type Pickering emulsions: amphiphilic calcium carbonate particles (VK-CaC112-1, China Hangzhou Weking New Material Co., Ltd.), a low-surface-energy substance long-chain alkane compound (n-hexadecane, China Shanghai Sinopharm Chemical Reagent Co., Ltd.) and water are mixed, and are emulsified to form oil-in-water type Pickering emulsion through a ultrasonic homogenizer. The total concentration of amphiphilic particles and low-surface-energy substance in the prepared Pickering emulsion is 80 mg/mL, the mass ratio of amphiphilic particles to low-surface-energy substance is 1:5, the ultrasonication power is 540 W, and the emulsifying time is 3 min.

A textile is finished by the Pickering emulsion through the one-step method: a polyester fiber woven fabric is subjected to conventional two-dipping and two-rolling finishing by using the stable oil-in-water type Pickering emulsion, and the pick-up ratio is 70%; and curing: the polyester fiber woven fabric is pre-cured for 3 min at the temperature of 80° C., and is cured for 3 min at the temperature of 120° C. to obtain a durable super-hydrophobic polyester fiber woven fabric.

A static contact angle between the durable super-hydrophobic polyester fiber woven fabric and water droplets is 150 degrees, and after the durable super-hydrophobic polyester fiber woven fabric is washed for 30 times according to the ISO 105-C10: 2007 testing method, the static contact angle still reaches up to 147 degrees.

What is claimed is:

1. A method for preparing durable super-hydrophobic fabrics through a facile method by using Pickering emulsion technology, comprising: amphiphilic particles stabilizing low-surface-energy substances in water to form Pickering emulsion, finishing a textile through the facile method by using the Pickering emulsion, and drying the textile to obtain a super-hydrophobic fabric, wherein the step of drying comprises pre-curing the fabric for 1-3 min at the temperature of 60-80° C. and curing the fabric for 1-3 min at the temperature of 120-160° C., or drying the fabric for 30-60 min at the temperature of 120-150° C., wherein the low-surface-energy substances are at least one of silicone oil, long-chain alkane compounds with carbon atom number $n \geq 16$ and perfluoroalkyl compounds with carbon atom number $n \leq 6$, wherein the total concentration of amphiphilic particles and low-surface-energy substances in the Pickering emulsion is 0-300 mg/mL, but not 0; wherein the mass ratio of amphiphilic particles to low-surface-energy substances in the Pickering emulsion is 1:0-30; but not 0, wherein when the low-surface-energy substances is the silicone oil, the total concentration of the amphiphilic particles and the low-surface-energy substances is 80-120 mg/ml, and the mass ratio of the amphiphilic nanoparticles to the low-surface-energy substances is 1:0.5-5.

2. The method for preparing the durable super-hydrophobic fabric through the facile method by using the Pickering emulsion technology according to claim 1, wherein the Pickering emulsion is oil-in-water type emulsion.

3. The method for preparing the durable super-hydrophobic fabric through the facile method by using the Pickering emulsion technology according to claim 1, wherein the amphiphilic particles are at least one of amphiphilic silicon dioxide, amphiphilic graphene oxide, amphiphilic graphene, amphiphilic carbon nanotubes, amphiphilic calcium carbonate, amphiphilic ferroferric oxide, microcrystalline celluloses, microcrystalline lignin and starch nanocrystals.

4. The method for preparing the durable super-hydrophobic fabric through the facile method by using the Pickering emulsion technology according to claim 1, wherein the textile is cellulosic fiber fabrics, polyester fiber fabrics, nylon, acrylic fiber fabrics, acetate fiber fabrics, wool fiber fabrics or blended fabrics from at least two kinds of the above-mentioned fabrics.

5. The method for preparing the durable super-hydrophobic fabric through the facile method by using the Pickering emulsion technology according to claim 1, wherein the finishing method is a padding method, a dipping method, a coating method or a spraying method.

6. The method for preparing the durable super-hydrophobic fabric through the facile method by using the Pickering emulsion technology according to claim 1, wherein the emulsifying method comprises homogenizing dispersion, cell smashing or ultrasonic dispersion.

* * * * *